US009408421B2

(12) United States Patent
Jackson

(10) Patent No.: US 9,408,421 B2
(45) Date of Patent: Aug. 9, 2016

(54) INTERCHANGEABLE BRASSIERE DEVICE

(71) Applicant: Ashawnte Jackson, Cincinnati, OH (US)

(72) Inventor: Ashawnte Jackson, Cincinnati, OH (US)

( * ) Notice: Subject to any disclaimer, the term of this patent is extended or adjusted under 35 U.S.C. 154(b) by 0 days.

(21) Appl. No.: 14/699,585

(22) Filed: Apr. 29, 2015

(65) Prior Publication Data

US 2015/0313291 A1 Nov. 5, 2015

Related U.S. Application Data

(60) Provisional application No. 61/988,364, filed on May 5, 2014.

(51) Int. Cl.
*A41C 3/00* (2006.01)
*A41C 3/06* (2006.01)

(52) U.S. Cl.
CPC ..... *A41C 3/0071* (2013.01); *A41C 3/0028* (2013.01); *A41C 3/0078* (2013.01); *A41C 3/06* (2013.01); *A41C 3/065* (2013.01)

(58) Field of Classification Search
CPC ... A41C 3/0065; A41C 3/0028; A61F 15/002
USPC ..... 450/58, 38, 81, 88
See application file for complete search history.

(56) References Cited

U.S. PATENT DOCUMENTS 6,231,424 B1 * 5/2001 Valentin ..... A41C 3/065 450/81
6,383,055 B2 * 5/2002 Valentin ..... 450/1
6,517,409 B2 * 2/2003 Flaherty ..... A41F 15/002 450/1
7,335,086 B1 * 2/2008 Karon ..... A41C 3/065 450/1
7,677,952 B2 * 3/2010 Wooley ..... A41C 3/065 450/81
8,337,275 B2 12/2012 Martins-Crawbuck et al.
8,936,504 B2 * 1/2015 Deal ..... A41C 3/065 450/39
9,089,171 B2 * 7/2015 Chen ..... A41C 3/065
2003/0003844 A1 * 1/2003 Jones ..... A41F 15/002 450/88
2009/0258572 A1 * 10/2009 Chayo ..... A41C 3/0028 450/39
2014/0057528 A1 * 2/2014 Deal ..... A41C 3/065 450/38

* cited by examiner

*Primary Examiner* — Gloria Hale
(74) *Attorney, Agent, or Firm* — Daniel Boudwin; Global Intellectual Property Agency

(57) ABSTRACT

An interchangeable brassiere device for wearing under various garments, such as backless and sleeveless shirts and dresses. The interchangeable brassiere device includes a pair of brassiere cups so as to be positioned on and provide support to a user's chest. The device further includes a plurality of interchangeable side panels that are removably secured to the ends of the brassiere cups that allow the brassiere cups to be removably secured to a user's chest. A first pair of interchangeable side panels extend from the ends of the brassiere cups, wherein the side panels include an adhesive so as to adhere to a user's skin. An alternative pair of side panels can interchange with the first pair of side panels, wherein the first ends of each alternative side panel are removably secured to the brassiere cups and the opposing ends of the side panels are removably secured to each other.

12 Claims, 3 Drawing Sheets

INTERCHANGEABLE BRASSIERE DEVICE

CROSS REFERENCE TO RELATED APPLICATION

This application claims the benefit of U.S. Provisional Application No. 61/988,364 filed on May 5, 2014. The above identified patent application is herein incorporated by reference in its entirety to provide continuity of disclosure.

BACKGROUND OF THE INVENTION

Field of the Invention

The present invention relates to interchangeable brassiere devices. More specifically, the present invention provides a pair of brassiere cups adapted to be positioned on and provide support to a user's chest, wherein a plurality of interchangeable side panels are removably secured to the ends of the brassiere cups adapted to allow the brassiere cups to be removably secured to a user's chest. A first pair of side panels extend from the brassiere cups adapted to be positioned horizontally along a user's side and terminate at the user's back. The first pair of side panels are composed of silicone and include an adhesive so as to adhere to a user's skin. An alternative pair of side panels are adapted to interchange with the first pair of side panels. The ends of the alternative pair of side panels are removably secured to the brassiere cups and adapted to be positioned around the user's back, wherein the opposing ends of the side panels are removably secured to each other.

Many women wear backless or strapless brassieres with summer garments and formal dresses having backless and sleeveless designs. Conventional brassieres, meaning brassieres that wrap around a user's back and include a pair of shoulder straps, can only be worn in a single manner or the only removable part of the brassiere are the shoulder straps. Additionally, most conventional backless brassieres are only suitable for one use before they are required to be disposed. Furthermore, conventional backless brassieres do not offer sufficient support and are uncomfortable to wear. Many women purchase a number of conventional, backless, and strapless brassieres in order to find a comfortable, well-fitting brassiere that is hidden when worn under various articles of clothing. This is a financial burden due to the expense of a single brassiere. Accordingly, there is a need in the prior art for a device that provides a comfortable pair of brassiere cups having interchangeable side panels and removable straps adapted to be worn under any type of garment and suitable for repeated use.

It is submitted that the present invention substantially diverges in design elements from the prior art and consequently it is clear that there is a need in the art for an improvement to existing interchangeable brassiere devices. In this regard the instant invention substantially fulfills these needs.

SUMMARY OF THE INVENTION

In view of the foregoing disadvantages inherent in the known types of interchangeable brassiere devices now present in the prior art, the present invention provides a new interchangeable brassiere device wherein the same can be utilized for providing convenience for the user when wearing various garments, including backless and sleeveless garments.

It is therefore an object of the present invention to provide a new and improved interchangeable brassiere device that has all of the advantages of the prior art and none of the disadvantages.

It is another object of the present invention to provide an interchangeable brassiere device comprising a pair of brassiere cups removably secured to a plurality of interchangeable side panels adapted to support the chest of a user.

Another object of the present invention is to provide an interchangeable brassiere device wherein a first pair of side panels comprise a first side panel and a second side panel extending from the pair of brassiere cups and adapted to be positioned horizontally along a user's side and terminate at the user's back, wherein the side panels include an adhesive so as to adhere to a user's skin.

Yet another object of the present invention is to provide an interchangeable brassiere device wherein an alternative pair of side panels adapted to be positioned around a user's back are interchangeable with the first pair of side panels, wherein the ends of the alternative pair of side panels are removably secured to the brassiere cups and the opposing ends of the alternative pair of side panels are removably secured to each other.

Yet another object of the present invention is to provide an interchangeable brassiere device further comprising a pair of shoulder straps, wherein each strap is removably secured to a loop disposed on each brassiere cup and a loop disposed on each of the alternative side panels.

Another object of the present invention is to provide an interchangeable brassiere device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
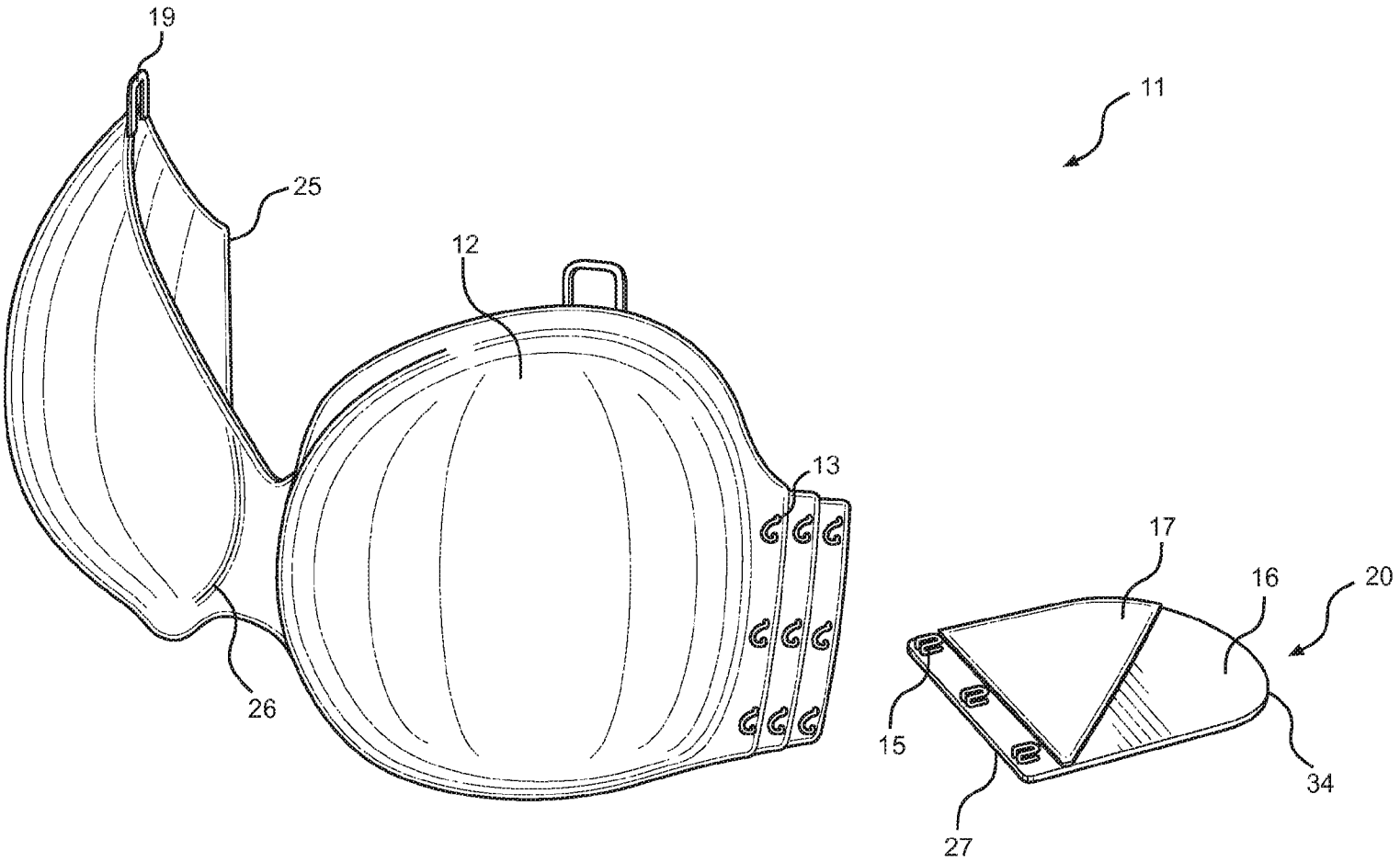
FIG. 1 shows a perspective view of an embodiment of the interchangeable brassiere device.

Reference is made herein to the attached drawings. Like reference numerals are used throughout the drawings to depict like or similar elements of the interchangeable brassiere device. For the purposes of presenting a brief and clear description of the present invention, the preferred embodiment will be discussed as used for wearing under various garments, including backless and sleeveless garments. The figures are intended for representative purposes only and should not be considered to be limiting in any respect.

Referring now to FIG. 1, there is shown a perspective view of an embodiment of the interchangeable brassiere device. The interchangeable brassiere device 11 comprises a pair of brassiere cups 12 adapted to be positioned on and provide support to the chest of a user. The first brassiere cup 12 is a mirror image of the second brassiere cup 12. Each brassiere cup 12 includes a first end 25 and an opposing second end 26, wherein the second end 26 of the first brassiere cup 12 is secured to the second end 26 of the second brassiere cup 12. The upper edge of each brassiere cup 12 includes a loop 19 adapted to fit a shoulder strap therethrough. The shoulder strap provides added support to the user's chest when wearing the brassiere. The first ends 25 of the brassiere cups 12 are removably secured to a plurality of interchangeable side panels 20 adapted to allow the brassiere cups to be removably secured to a user's chest. The first end 25 includes one or more fasteners 13 adapted to receive one or more mating fasteners disposed on the first end 27 of a side panel 20. The brassiere cup 12 is removably secured to a side panel 20 by any suitable fastener 13, such as hook 15 and eye 13 closures or snap closures In some embodiments, the second ends of the brassiere cups are removably secured together by a fastener, such as a clip, wherein the interchangeable side panel comprises a single elongated panel that is flat. In this way, the interchangeable brassiere device is adapted to be secured to a user from the front of the user between the brassiere cups, wherein the side panel is adapted to rests flush against a user's back. A front closure is conveniently positioned and desired by some users. A flat side panel is also desired for comfort and is adapted to fit under certain garments in an aesthetically appealing manner.

The first pair of interchangeable side panels 20 comprises an identical first side panel 20 and second side panel 20. Each of these side panels 20 are flat, wherein the edges of the second end 34 are curved so as to prevent a user from exposure to sharp edges when the device 11 is worn. The side panel 20 is preferably composed of silicone 16 in order to provide a comfortable, clear material adapted to be disposed on a user. The side panel 20 further comprises an interior surface, adapted to contact a user's skin, and an opposing exterior surface. The interior surface comprises an adhesive 17 adapted to adhere the side panel 20 to the user's skin. Any suitable adhesive can be used, such as pressure sensitive adhesive or hypoallergenic adhesive. In this way, the pair of side panels 20 support the brassiere cups 12 on the user's chest.

In the illustrated embodiment, the first pair of interchangeable side panels 20 are removably secured to the pair of brassiere cups 12 by hook 15 and eye 13 closures. The first end 25 of the brassiere cup 12 comprises a plurality of columns and rows of eyes 13 adapted to receive hooks 15 disposed on the first end 27 of the side panel 20, such that the positioning of the side panel 20 is adjustable. The columns are vertically disposed and the rows are horizontally disposed, wherein the hooks 15 and eyes 13 are each preferably spaced at fixed intervals. The first end 27 of the side panel comprises a column of hooks 15 adapted to be removably secured to a column of eyes 13, whereby a user chooses such column of eyes 13 according to the desired positioning of the side panel 20. The adjustability of the length of the side panel 20 is adapted to accommodate weight fluctuation or growth of the user.

Figure 2:
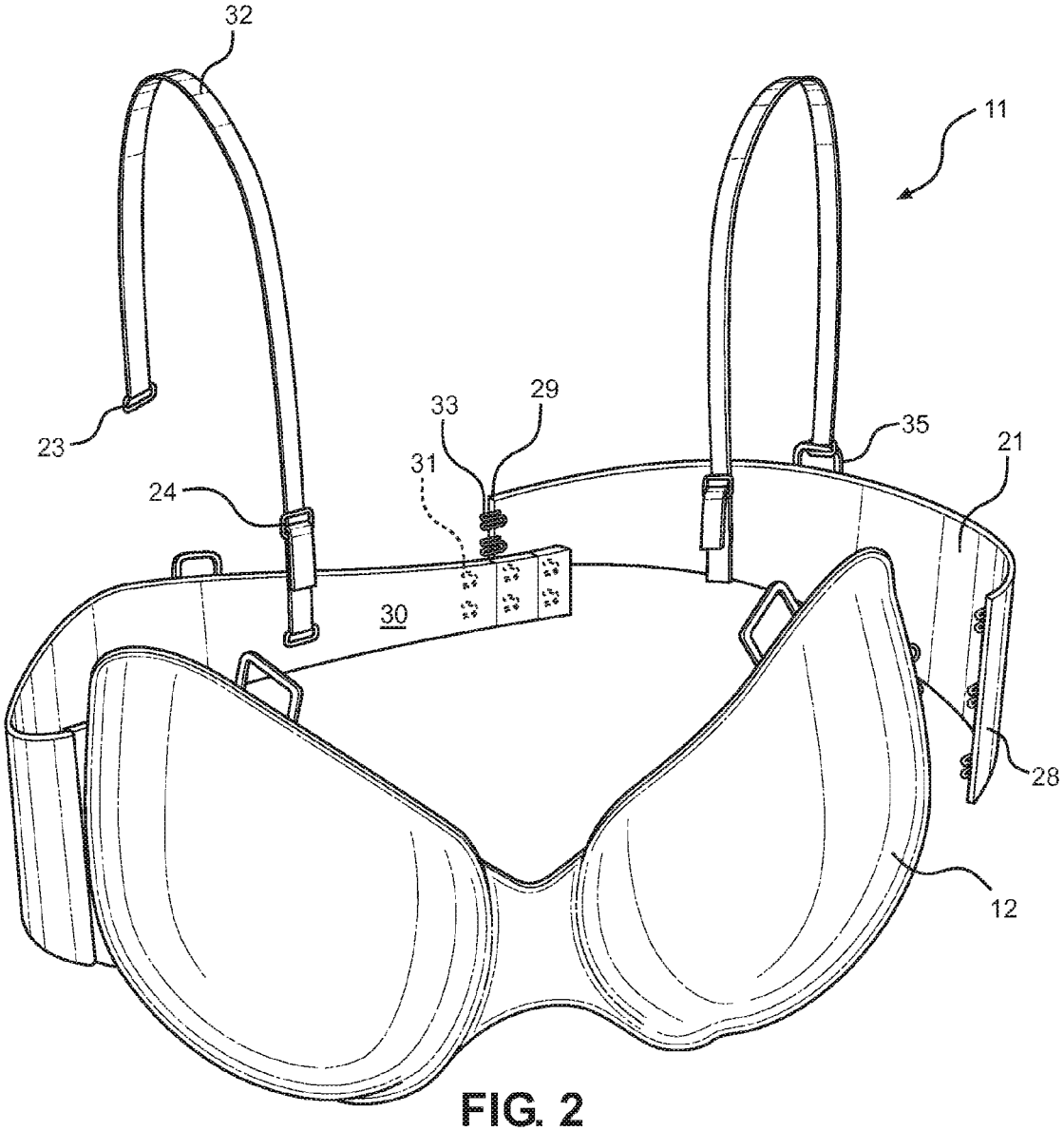
FIG. 2 shows a perspective view of an alternative pair of side panels of the interchangeable brassiere device.

Referring now to FIG. 2, there is shown a perspective view of an alternative pair of side panels of the interchangeable brassiere device. The first pair of side panels are interchangeable with one or more alternative pairs of side panels 21. A pair of side panels 21 are adapted to interchange by detaching the hooks of the first pair of side panels from the eyes of the pair of brassiere cups and removably securing an alternative pair of side panels 21 to the pair of brassiere cups 12. An alternative pair of side panels 21 comprises a first side panel 21 and a second side panel 21 each having an interior 30 surface and an exterior surface. The first ends 29 of each side panel 21 are removably secured to the first ends of the brassiere cups 12 and the second end 29 of the first side panel 21 is removably secured to the second end 29 of the second alternative side panel 21. The first ends of each side panel 21 comprise a column of hooks adapted to be removably secured to a column of eyes disposed on each brassiere cup 12, whereby a user chooses such column of eyes according to the desired positioning of the side panel 21.

The second ends 29 of the alternative pair of side panels 21 are removably secured by one or more fasteners, such as hook 33 and eyes 31 closures. A first side panel 21 comprises a plurality of hooks 33 configured in a column on the interior surface 30 and the second side panel 21 comprises a plurality of columns and rows of the corresponding eye 31 closures on the exterior surface, whereby a user chooses such column of eyes 31 according to the desired positioning of the side panel 20. The columns are vertically disposed and the rows are horizontally disposed, wherein the hooks 33 and eyes 32 are each preferably spaced at fixed intervals. In this way, the interchangeable brassiere device functions as a strapless brassiere, wherein the alternative side panels 21 extend horizontally from the brassiere cups 12 and are adapted to be secured around the user's back.

The upper edge of each of the side panels 21 comprise a loop 35 adapted to receive a shoulder strap 32 therethrough. The shoulder straps 32 are adapted to be positioned in various configurations, such as traditional parallel straps, criss-cross, halter, or one shoulder. Each end of a shoulder strap 32 comprises a fastener 23, such as a hook 23, that removably secures to a loop 35. The shoulder strap 32 further includes an adjustment mechanism 24 adapted to adjust the length of the shoulder strap 32 in order to allow a user to position each shoulder strap 32 in various configurations.

Figure 3:
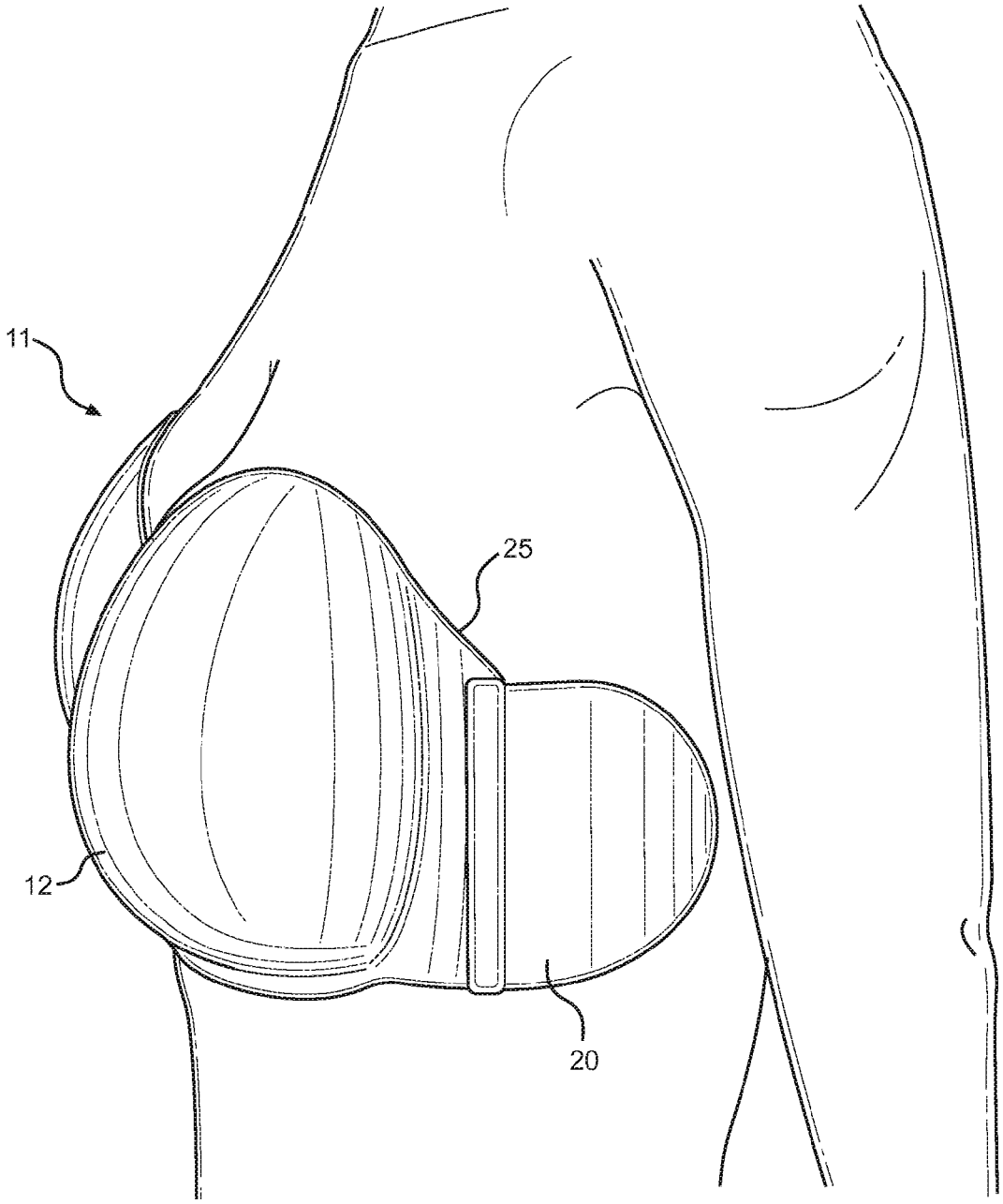
FIG. 3 shows a perspective view of an embodiment of the interchangeable brassiere device in use.

Referring now to FIG. 3, there is shown a perspective view of an embodiment of the interchangeable brassiere device in use. The purpose of each pair of side panels 20 is to provide support to the brassiere cups 12 while providing the user with an interchangeable brassiere device 11 adapted to be concealed when worn with a specific type of garment. For example, the first pair of side panels 20 are adapted to be worn under a backless shirt or dress. Each side panel 20 extends from the first end 25 of a brassiere cup 12 and positioned along a user's side, whereby the panel 20 terminates at the user's back.

The alternative pair of side panels are adapted to be worn with a strapless or any length sleeve shirt or dress. An end of a shoulder strap removably secures to a brassiere cup 12, whereby the shoulder strap is adapted to extend upward along a user's chest and over the user's shoulders. The opposing end of the shoulder strap is adapted to extend downward across a user's back and connect to an alternative side panel, thereby supporting a user's chest while providing a suitable brassiere device 11 configuration that allows the brassiere device 11 to remain unexposed beneath a user's garments.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An interchangeable brassiere device, comprising:

a first brassiere cup and a second brassiere cup adapted to be positioned on a user's chest each having a first end and a second end, wherein said second end of said first brassiere cup is secured to said second end of said second brassiere cup;

a plurality of interchangeable side panels, wherein a first side panel is removably secured to said first end of said first brassiere cup and a second side panel is removably secured to said first end of said second brassiere cup;

one or more fasteners positioned in a plurality of columns on said first end of said first brassiere cup and said first end of said second brassiere cup;

said one or more fasteners adapted to removably secure to one or more mating fasteners disposed on a first end of said first side panel and a first end of said second side panel, respectively, such that the positioning of said plurality of interchangeable side panels is adjustable relative to said pair of brassiere cups.

2. The interchangeable brassiere device of claim 1, wherein said one or more fasteners are hook and eye closures.

3. The interchangeable brassiere device of claim 1, wherein said first side panel and said second side panel extend from said first brassiere cup and said second brassiere cup and adapted to be positioned along said user's side and terminate at said user's back.

4. The interchangeable brassiere device of claim 3, said first side panel and said second side panel are composed of silicone.

5. The interchangeable brassiere device of claim 1, wherein an interior surface of each of said first side panel and said second side panel comprise adhesive adapted to removably secure to a user's skin.

6. The interchangeable brassiere device of claim 3, wherein said first side panel and said second side panel adapted to terminate at said user's back are interchangeable with an alternative first side panel and an alternative second side panel.

7. The interchangeable brassiere device of claim 1, wherein said first side panel and said second side panel each comprise elongated panels having a first end and a second end, wherein said first end extends from said pair of brassiere cups adapted to be disposed around said user's back, wherein said second end of said first side panel removably attaches to said second end of said second side panel.

8. The interchangeable brassiere device of claim 7, wherein said second end of said first side panel removably secures to said second end of said second side panel by one or more fasteners.

9. The interchangeable brassiere device of claim 8, wherein said one or more fasteners are hook and eye closures.

10. The interchangeable brassiere device of claim 1, further comprising a pair of shoulder straps, wherein a first shoulder strap is removably secured to said first brassiere cup and said first side panel and a second shoulder strap is removably secured to said second brassiere cup and said second side panel.

11. The interchangeable brassiere device of claim 10, wherein said pair of brassiere cups and said plurality of interchangeable side panels each comprise a loop disposed on an upper edge thereof adapted to receive said pair of shoulder straps.

12. The interchangeable brassiere device of claim 11, wherein said pair of shoulder straps each comprise a hook on a first end and a second end, wherein said hook is removably secured to said loop.

* * * * *